US005341871A

United States Patent [19]

Stelzer

[11] Patent Number: 5,341,871

[45] Date of Patent: Aug. 30, 1994

[54] ENGINE COOLING FAN ASSEMBLY WITH SNAP-ON RETAINERS

[75] Inventor: Sean R. Stelzer, Farmington Hills, Mich.

[73] Assignee: General Motors Corporation, Detroit, Mich.

[21] Appl. No.: 78,334

[22] Filed: Jun. 21, 1993

[51] Int. Cl.[5] ..... F04D 29/64

[52] U.S. Cl. ..... 165/121; 180/68.4; 248/604

[58] Field of Search ..... 165/121 I; 180/68.4; 248/73, 604, 605

[56] References Cited

U.S. PATENT DOCUMENTS

| | | | |
|---|---|---|---|
| 3,795,274 | 3/1974 | Fieni | 165/122 |
| 4,304,148 | 12/1981 | Hamman | 248/73 |
| 4,685,513 | 8/1987 | Longhouse et al. | 165/121 |
| 4,700,913 | 10/1987 | Hirano et al. | 248/73 |
| 4,795,116 | 1/1989 | Kohut et al. | 248/73 |
| 4,805,868 | 2/1989 | Claude | 248/603 |
| 4,811,922 | 3/1989 | Yoneyama | 248/73 |
| 4,840,334 | 6/1989 | Kikuchi | 248/73 |
| 5,180,279 | 1/1993 | McLane-Goetz et al. | 415/177 |

*Primary Examiner*—Stephen M. Hepperle
*Attorney, Agent, or Firm*—A. Michael Tucker

[57] ABSTRACT

An engine cooling fan assembly includes a mounting bracket having outwardly extending legs. A motor is mounted to a central hub of the mounting bracket. A multi-bladed fan is attached to and driven by the motor. A least one leg of the mounting bracket has a formed end with a ramp, a resilient grommet retained by a flange, and recesses between the ramp and grommet. A retainer is removably received on the end as barbs of the retainer are received and seated in the recess.

8 Claims, 2 Drawing Sheets

ENGINE COOLING FAN ASSEMBLY WITH SNAP-ON RETAINERS

BACKGROUND OF THE INVENTION

1. Field of the Invention

The present invention relates generally to engine cooling fan assemblies, and in particular is concerned with snap-on retainers for securing legs of a mounting bracket to a support.

2. Description of the Related Art

Electrically driven cooling fans in vehicular engine compartments are well-known. Generally, an electric motor is mounted on a hub of a bracket secured adjacent an engine coolant radiator to provide a cooling airflow through the radiator. The control of the motor and the fan can be accomplished by any suitable manner. Oftentimes, a stationary shroud and/or a rotating ring shroud are used in combination with a fan to increase the cooling efficiency.

A mounting bracket includes a plurality of legs extending outwardly from the hub. Various techniques are known for attaching these legs to corresponding support elements. For example, U.S. Pat. No. 4,685,513 illustrates threaded fasteners securing the upper legs, while the lower legs are inserted into corresponding recesses. U.S. Pat. No. 4,805,868 illustrates threaded fasteners and nuts securing the upper and lower legs.

The art continues to seek improvements. It is desirable to quickly and economically secure the legs of a mounting bracket on a support to maintain the placement of an engine cooling fan assembly. Also, it is desirable that the means for securing the legs be able to be quickly removed if a fan assembly needs to be withdrawn from an engine compartment.

SUMMARY OF THE INVENTION

The present invention includes an engine cooling fan assembly having snap-on retainers for securing legs of a mounting bracket to a support. The legs of conventional mounting brackets can be easily and economically adapted to receive snap-on retainers. The retainers simplify installation of a cooling fan assembly and reduces the time required for installation. If desired, the retainers can be easily withdrawn to permit removal of the cooling fan assembly.

In a preferred embodiment, an engine cooling fan assembly includes a mounting bracket having outwardly extending legs. A motor is mounted to a central hub of the mounting bracket. A multi-bladed fan is attached to and driven by the motor. At least one leg of the mounting bracket has a formed end with a ramp, a resilient grommet retained by a flange, and recesses between the ramp and grommet. A retainer is removably received on the end as barbs of the retainer are received and seated in the recesses.

DETAILED DESCRIPTION OF THE PREFERRED EMBODIMENT

Figure 1:
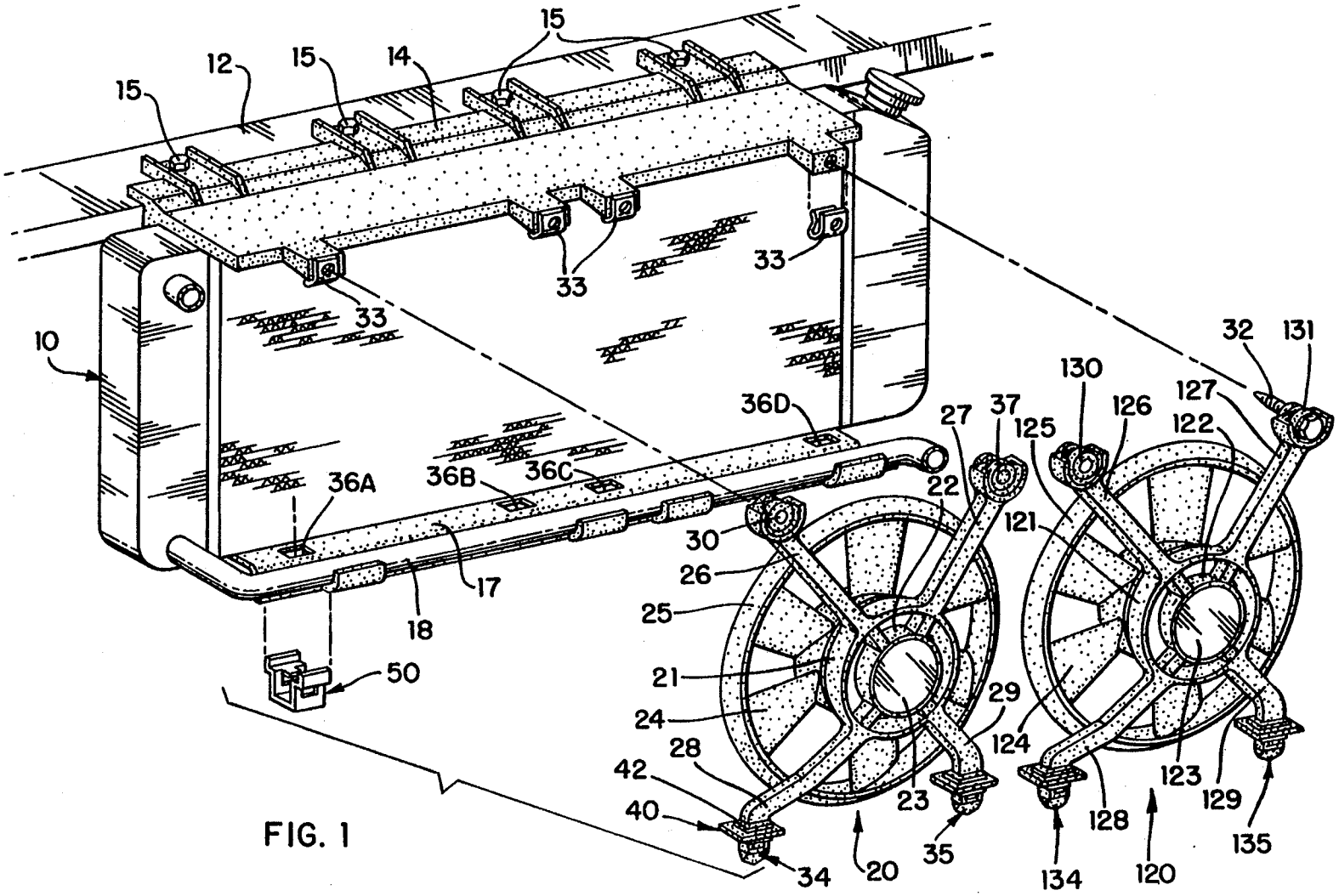
FIG. 1 is an exploded perspective view of an automotive engine cooling radiator and a pair of engine cooling fan assemblies, wherein each assembly includes a cooling fan, a motor, a mounting bracket and snap-on retainers securing each of the lower legs of the mounting bracket to a lower mounting panel.

A conventional engine cooling radiator 10 illustrated in FIG. 1 is connected to an elongated upper radiator support 12 by an upper mounting panel 14 and a plurality of fasteners 15. An elongated lower radiator support 16 (FIG. 3 only) and associated mounting panel 17 receive a lower portion of the radiator 10 and a by-pass hose 18. The radiator 10 is preferably positioned at the front of a vehicle in front of an internal combustion engine (not illustrated). The radiator 10 is hydraulically connected to the engine by suitable hoses so that engine cooling fluids can circulate therebetween in a well-known manner.

First and second cooling fan assemblies 20 and 120 are mounted side-by-side adjacent the rear surface of the radiator 10. Each fan assembly 20, 120 induces a flow of air through the radiator 10 when activated by conventional thermostatic controls (not illustrated). For purposes of this description, fan assembly 120 can be identical to fan assembly 20. For ease of description, the elements of fan assembly 120 are labeled with the reference numerals of corresponding elements of fan assembly 20 plus 100.

Fan assembly 20 includes a mounting bracket 21 preferably molded from a suitable plastic material. The bracket 21 has a central portion 22 mounting an electric motor 23 which drives a multi-bladed fan 24 having a rotating ring shroud 25. Extending outwardly from the central portion 22 are two upwardly extending legs 26 and 27 and two downwardly projecting legs 28 and 29.

Preferably, legs 26 and 27 mount respective resilient grommets 30 and 31 in their terminating end portions. Threaded fasteners 32 extend through grommets 30 and 31 and into threaded connection with nuts 33 provided on the upper mounting panel 14 to secure legs 26 and 27 to the upper mounting panel 14.

Legs 28 and 29 terminate in respective ends 34 and 35 which are received in respective slots 36A and 36B of the lower mounting panel 17. Ends 35, 134 and 135 are identical to end 34 which is illustrated in detail in FIG. 2. End 34 includes a terminating V-shaped point or ramp 38 which acts as a spreader as described below. A resilient grommet 40 is received over the ramp 38 and is positioned against a retaining flange 42, which can be formed as desired, including as a plurality of nibs. The grommet 40 includes a tubular portion 44 which receives end 34 and a planar portion 46 which rests on the lower mounting panel 17 when the fan assembly 20 is installed. Recesses 48A and 48B provided between the ramp 38 and the grommet 40 form ledges 49A and 49B. In other embodiments, an opening in the end 34 can provide a single ledge. Ramp 38 projects below a lower surface of panel 17 when the fan assembly 20 is placed on the lower mounting panel 17.

Figure 3:
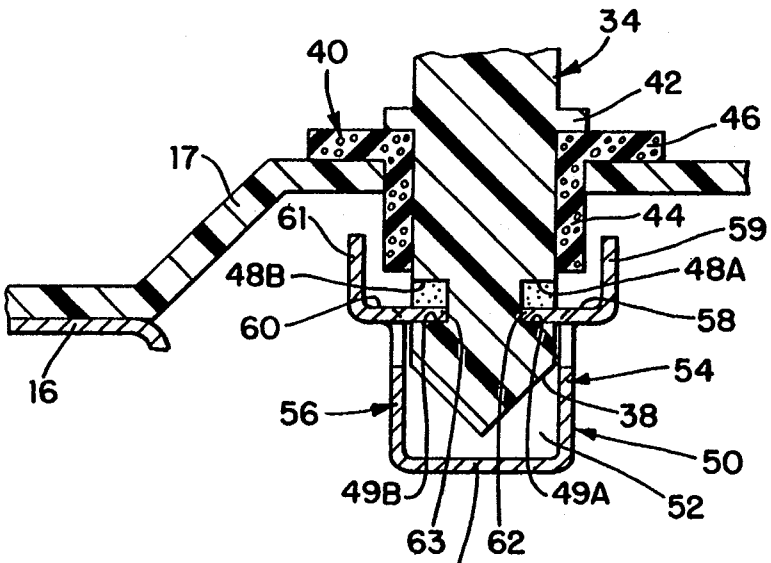
FIG. 3 is a sectional view of the mounting bracket leg and snap-on retainer of FIG. 2 after installation.
Figure 2:
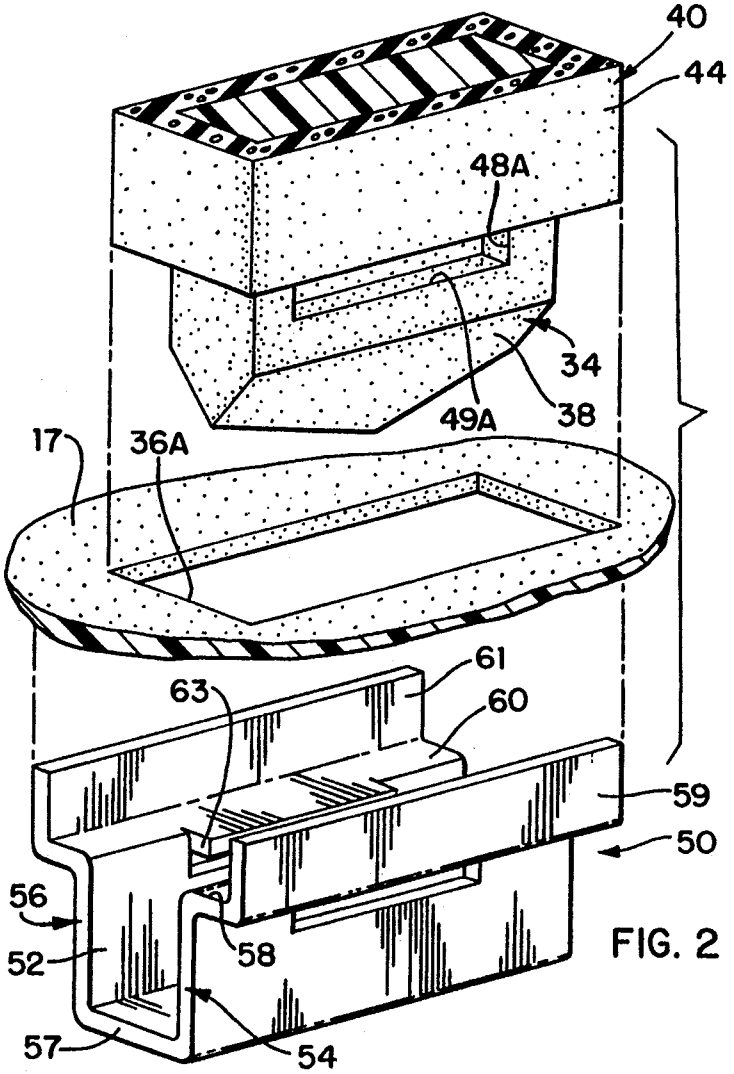
FIG. 2 is an enlarged exploded perspective view of a lower portion of one of the mounting bracket legs and a respective snap-on retainer of FIG. 1 prior to installation.

A snap-on retainer, indicated generally at 50, is illustrated best in FIGS. 2 and 3. The retainer 50 is a stepped, U-shaped element preferably formed as a one-piece member having a central well 52 formed by side walls 54, 56 and a bottom wall 57. Side wall 54 includes a step 58 terminating in an upwardly extending portion 59. Side wall 56 includes a step 60 and portion 61 complementary to step 58 and portion 59. An inwardly projecting barb 62 is formed in side wall 54, and a similar bar 63 is formed in side wall 56. A retainer 50 is forced upwardly over each end 34, 35, 134, 135 until the barbs 62, 63 are received in the recesses 48A, 48B and rest on the ledges 49A, 49B. As the retainer 50 is pushed upwardly, ramp 38 spreads barbs 62, 63 apart until the barbs 62, 63 reach the recesses 48A, 48B, at which time the barbs 62, 63 spring back inwardly and are seated on the ledges 49A, 49B. The portions 59 and 61 extend upwardly about the outer surface of the annular portion 44 of the grommet 40 and tend to laterally locate the retainer 50.

Retainers 50 provide a simple and quick means for securing the lower legs 34, 35, 134, 135 of fan assemblies 20 and 120 to a lower mounting panel 17. If it is desirable to remove a fan assembly 20, 120, side walls 54, 56 can be pried apart until the barbs 62, 63 clear the recesses 48A, 48B so that a retainer 50 can then be pulled downwardly away from an end 34, 35, 134, or 135.

Although the present invention has been described with reference to a preferred embodiment, workers skilled in the art will recognize that changes may be made in form and detail without departing from the spirit and scope of the invention.

The embodiments of the invention in which an exclusive property or privilege is claimed are defined as follows,

What is claimed is:

1. An engine cooling fan assembly comprising:

(a) a mounting bracket having outwardly extending legs;

(b) a motor mounted to a central hub of the mounting bracket;

(c) a fan attached to and driven by the motor;

(d) a formed end on at least one leg of the mounting bracket having a ramp, a resilient grommet retained by flange means and a recess between the ramp and grommet; and (e) a retainer removably snapped onto each end, wherein the retainer includes barb means received in the recess to secure the retainer to the end.

2. The fan assembly specified in claim 1 wherein the recess in the end forms a ledge which seats the retainer barb means.

3. The fan assembly specified in claim 1 wherein the flange is integrally formed with the end.

4. The fan assembly specified in claim 1 wherein the grommet includes a tubular portion and a planar portion.

5. In combination with a radiator through which engine coolant is circulated and support structure adjacent to the radiator, an engine cooling fan assembly comprising:

(a) a mounting bracket having a central hub and at least one upwardly extending leg and at least one downwardly extending leg;

(b) means for attaching the upwardly extending leg to the support structure;

(c) a formed end on the downwardly extending leg having a ramp, a recess and a resilient grommet, wherein the end is inserted into a complementary opening of the support structure and extends below a lower surface of the support structure; and (d) a snap-on retainer having barbs which are forced apart by the ramp as the retainer is pushed on the end until the barbs are seated in the recess.

6. The combination of claim 5 wherein the end includes a flange to position the grommet on the end.

7. The combination of claim 5 wherein the grommet includes a planar portion seated on an upper surface of the support structure when the end is inserted into a respective opening.

8. The combination of claim 5 wherein an electrical motor and attached cooling fan are mounted on the hub.

* * * * *